United States Patent [19]

Lovik

[11] Patent Number: 5,036,985

[45] Date of Patent: Aug. 6, 1991

[54] BALLOON SCULPTURING SYSTEM

[76] Inventor: Craig J. Lovik, 8565 Custer School Rd., Custer, Wash. 98240

[21] Appl. No.: 481,495

[22] Filed: Feb. 16, 1990

[51] Int. Cl.[5] ..... A47F 7/00

[52] U.S. Cl. ..... 211/13; 446/222

[58] Field of Search ..... 211/13, 61, 70, 196, 211/205, 207; 446/222

[56] References Cited

U.S. PATENT DOCUMENTS

| | | | |
|---|---|---|---|
| 929,897 | 8/1909 | Taylor | 211/70 |
| 2,017,088 | 10/1935 | Bihler | 211/70 |
| 3,116,730 | 1/1964 | Tingley | 211/70 X |
| 3,366,999 | 2/1968 | Darby . | |
| 3,472,389 | 10/1969 | Lowe | 211/70 |
| 4,879,823 | 11/1989 | Collins | 446/222 X |
| 4,936,532 | 6/1990 | Williams | 446/222 X |
| 4,953,713 | 9/1990 | Yaffe | 446/223 X |

*Primary Examiner*—Robert W. Gibson, Jr.

*Attorney, Agent, or Firm*—Cassidy, Vance & Tarleton

[57] ABSTRACT

A balloon sculpturing system comprising a sculpturing stand (12) formed of an upright support port (14) and base (16) having a sculpturing ring (18) mounted thereon for holding a plurality of balloons (20) in a decorative arrangement. The sculpturing ring (18) comprises a cylindrical sidewall (40) having an open first end (44) and an open second end (46) communicating through a longitudinal axial bore (42) that is sized to permit mounting of the ring (18) over the support post (14). A plurality of slots (48) are formed in the cylindrical wall (40) to hold the constricted neck portion (22) of each balloon (20) such that the neck portions (22) are stretched across the bore (42) and frictionally engage the upright support post (14) to hold the sculpturing ring (18) in position.

19 Claims, 4 Drawing Sheets

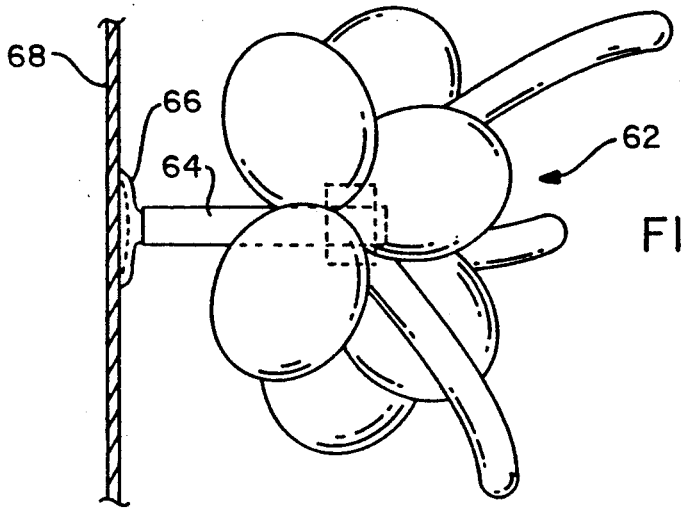
FIG. 6
FIG. 7
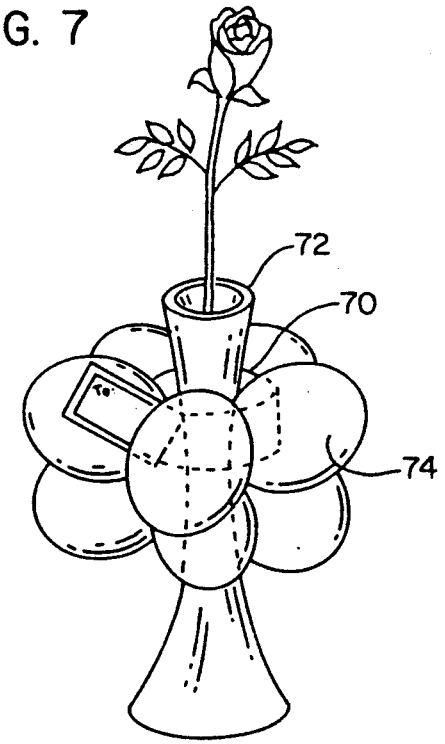
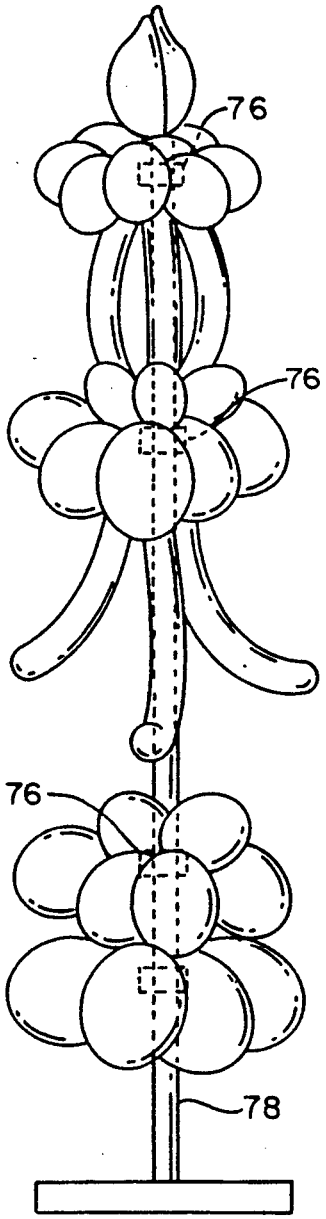
FIG. 8

FIG. 9
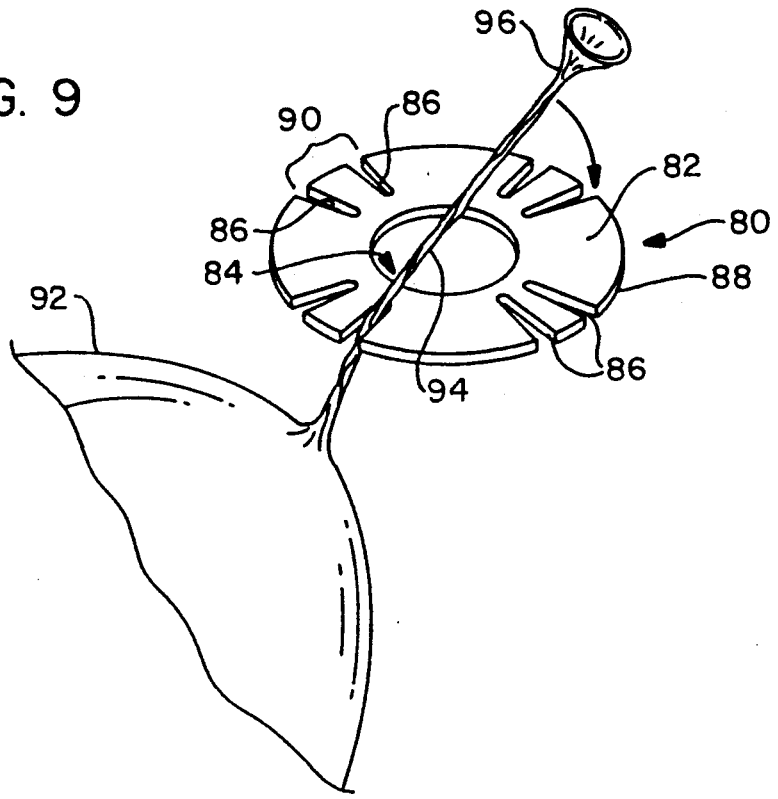
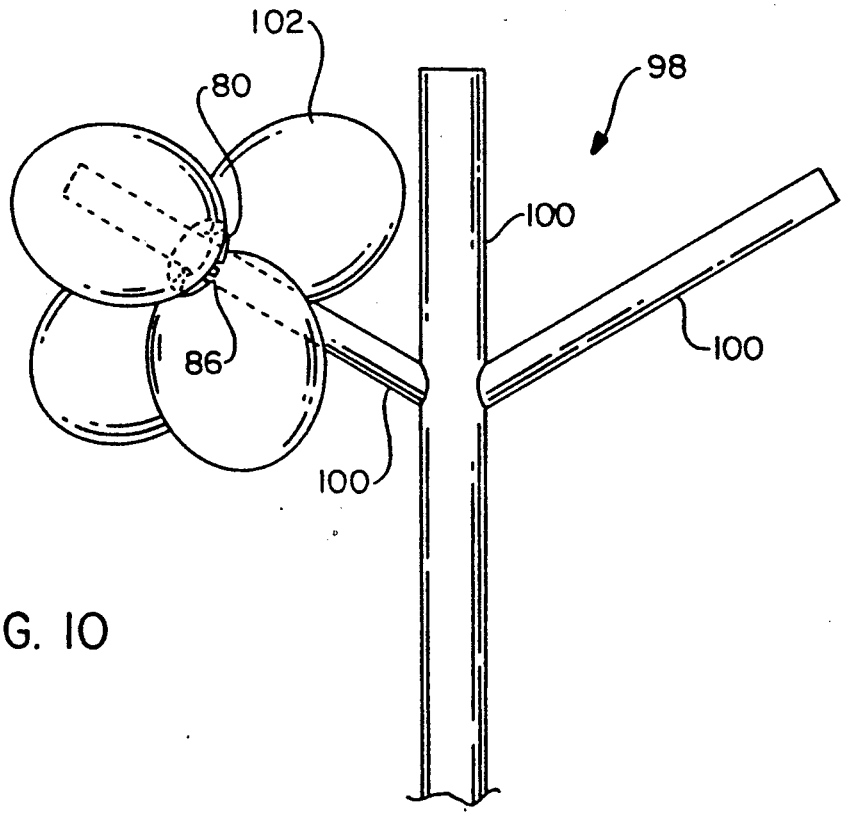
FIG. 10

BALLOON SCULPTURING SYSTEM

TECHNICAL FIELD

The present invention pertains to the arranging and displaying of balloons, and, more particularly, to a balloon sculpturing system for displaying a decorative arrangement of a plurality of balloons.

BACKGROUND OF THE INVENTION

Gas-filled bladders, such as conventional balloons, are frequently used as decorative displays for celebrations and other festive occasions such as birthdays, holidays, anniversaries, etc. These conventional balloons are of the type having a constricted neck portion that terminates at one end in an inflation aperture and at the other end in an imperforate inflatable sidewall. Several devices have been developed for clampingly holding the neck portions of one or more inflatable balloons in a sealed configuration while at the same time displaying the balloons in a decorative fashion.

One such device is disclosed in U.S. Pat. No. 3,366,999, issued to Darby on Feb. 6, 1968. Darby discloses a balloon holder and seal consisting of an annular plastic body having a transverse sidewall with a plurality of spaced slots each communicating with an opening in the transverse wall. The peripheral wall also has a plurality of additional slots associated with the first named slots to form pairs of slots extending from opposite ends of the peripheral wall, with each pair of slots being sized and shaped to hold the neck portion of a balloon so that the inflated portion projects radially outward from the peripheral wall. A central opening is provided in the transverse wall through which the neck portion of a balloon is placed. Additional balloons are placed in the pairs of slots so that a decorative arrangement is achieved. The annular plastic body acts as a stand for holding the arrangement of balloons.

One disadvantage of Darby is that the annular plastic body cannot be used in combination with other annular plastic bodies or in combination with other structural elements to form unique and fanciful decorative displays. More particularly, the position of the slots around the annular plastic body of Darby does not permit the neck portions of the balloons to frictionally engage any post that could be inserted through the central opening in the transverse wall. Consequently, other attachment means must be provided if mounting the annular plastic body to another structure were desired. In addition, each pair of slots in Darby opens to opposite ends of the annular plastic body, requiring the balloons to be inserted through the transverse wall before they can be sealed in the slots. Consequently, the complicated arrangement of slots in Darby makes it very difficult to mount a balloon and it provides no means for holding the plastic body to other structural members.

SUMMARY OF THE INVENTION

The present invention overcomes the disadvantages of the known prior art by providing a balloon sculpturing system that facilitates the mounting and displaying of one or more clusters of balloons to one or more structural supporting members. The system comprises at least one elongate post and a mounting member that holds the neck portion of a balloon and mounts on the elongate post such that the neck portion of the balloons frictionally engages the post to retain the holding and mounting member at a desired location on the post.

In accordance with another aspect of the present invention, the elongate post member includes a base or other means for supporting the balloon sculpturing system on a support surface such as a wall or table.

In accordance with yet another aspect of the present invention, the elongate post can comprise one or more elongate posts. The additional posts can be mounted to a central post or to each other to create a unique arrangement of posts for displaying one or more clusters of balloons.

In accordance with a further aspect of the present invention, the holding and mounting member comprises an annular wall member having a central opening that is sized to permit the wall member to be slidably received over an elongate post. In addition, the wall member includes at least two pair of diametrically opposed slots, each slot being sized to frictionally hold the neck portion of a balloon. Each pair of slots is positioned around the periphery of the wall member such that the neck portion of each balloon will be stretched across the central opening without intersecting the longitudinal axis of the central opening and each pair of mounted neck portions will be spaced apart a linear distance no greater than the thickness of the elongate post.

In accordance with yet another aspect of the present invention, the wall member comprises a cylindrical ring having a first end that communicates with a second end through a central longitudinal bore. Furthermore, each of the slots opens to either of the first and second ends and partially extends longitudinally toward the other of the first and second ends such that all of the slots open to the same end.

As will be readily appreciated from the foregoing description, the present invention provides a balloon sculpturing system that permits the easy and rapid insertion of the neck portion of a balloon into the slots on the mounting ring. After the desired number of balloons are mounted on the ring, the ring is readily placed over a support post and held in position by the lateral force exerted by the neck portion of each of the balloons mounted on the ring. The position of the ring can be easily changed by sliding it along the length of the post. When the balloons are inflated, they substantially conceal the mounting ring and the supporting structure. With this sculpturing system, virtually any three-dimensional structure can be formed from balloons.

BRIEF DESCRIPTION OF THE DRAWINGS

The foregoing and other features and advantages of the present invention will be more readily appreciated as the same becomes better understood from the detailed description of the invention when taken in conjunction with the following drawings, wherein:

FIG. 6 is a side view of an alternative embodiment of a balloon sculpturing system formed in accordance with the present invention having a cluster of balloons mounted thereon;

FIG. 7 is an isometric view of yet another alternative embodiment of the balloon sculpturing system formed in accordance with the present invention illustrating a balloon mounting ring mounted on a flower vase;

FIG. 8 is a further alternative embodiment of the balloon sculpturing system of the present invention illustrating a plurality of balloon mounting rings mounted on a single post with a multiplicity of balloons mounted thereon;

FIG. 9 is an isometric view of a sculpturing disc formed in accordance with the present invention; and FIG. 10 is a side view of a balloon sculpturing system utilizing a plurality of support posts.

DETAILED DESCRIPTION OF THE PREFERRED EMBODIMENT

Figure 1:
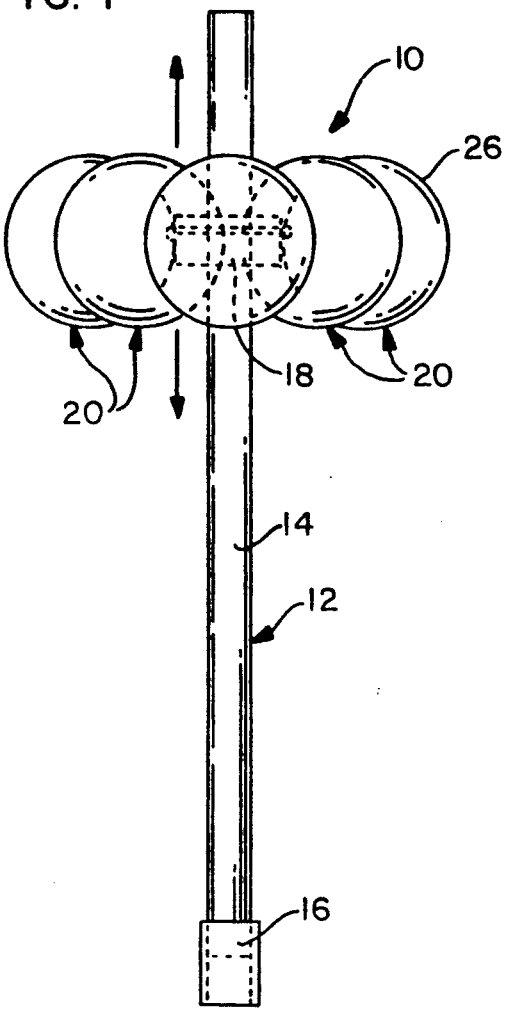
FIG. 1 is a side view of an assembled balloon sculpturing system formed in accordance with the present invention having a multiplicity of balloons mounted thereon.

Referring initially to FIG. 1, a balloon sculpturing system 10 formed in accordance with the present invention is illustrated therein. The balloon sculpturing system 10 comprises generally a sculpturing stand 12, which includes an upright support post 14 and a base 16, and a sculpturing ring 18. A plurality of balloons 20 are mounted to the sculpturing ring 18 in a decorative arrangement.

Figure 3:
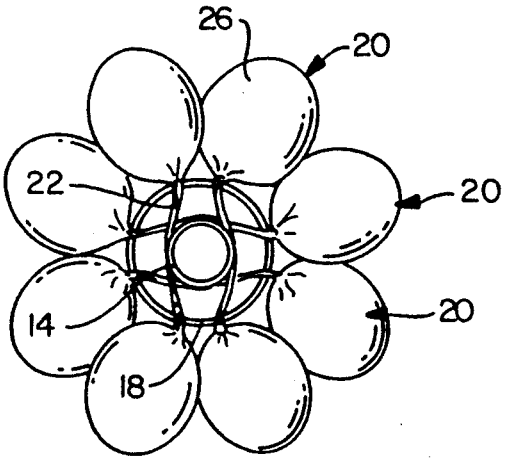
FIG. 3 is a top plan view of an assembled balloon sculpturing system of FIG. 1.

All of the balloons 20 illustrated in FIG. 1 are commercially available and will not be described in detail herein. Briefly, each balloon 20 is of the type having a constricted neck portion 22 (shown more clearly in FIG. 4) terminating at one end in an inflation aperture 24 and at the other end in an imperforate inflatable sidewall 26. As will be apparent to those skilled in the art, the degree and manner of inflation thereof are controlled in accordance with the invention to produce individual shapes and sizes that vary dependent upon the visual impression that the particular balloon designer wishes to create. Thus, the color, shape, size, and material are not critical, but will be selected to be consistent with the impression that the designer is attempting to create. As shown in FIGS. 1 and 3, the plurality of balloons 20 are of substantially a spherical shape. They are mounted in coplanar relationship to form a ring of balloons around the upright support post 14.

Figure 2:
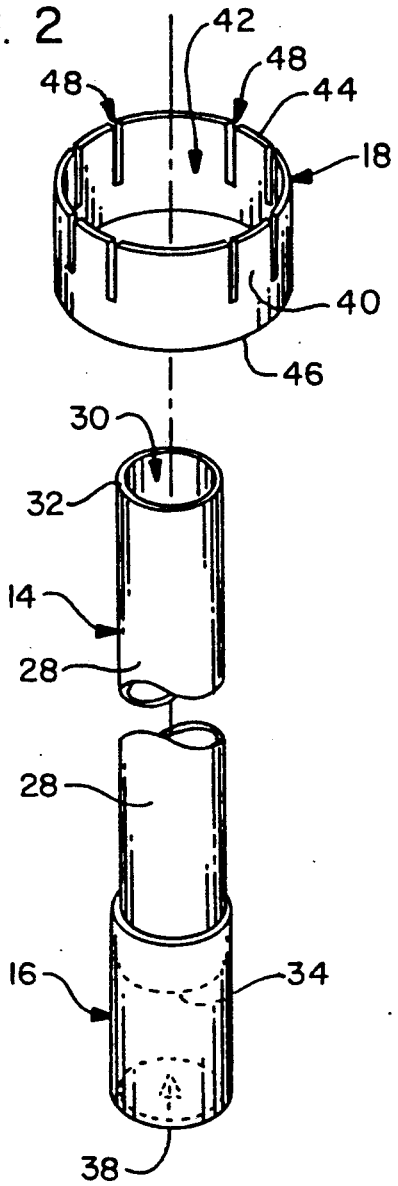
FIG. 2 is an exploded isometric view of the components of the balloon sculpturing system of FIG. 1.

As shown more clearly in FIG. 2, the upright support posts 14 are formed from a cylindrical tube 28 having a longitudinal axial bore 30 that communicates with a first end 32 and a second end 34. The base 16 is formed from a short tube 36 having a longitudinal axial bore 38 with a diameter sized slightly larger than the outside diameter of the upright support post 14. As such, the second end 34 of the tube 28 is slidably receivable within the bore 38 of the base 16. Preferably, the post 14 and the base 16 are sized such that the post 14 will have a tight fit within the base 16. Both the post 14 and the base 16 may be constructed of plastic, metal, or other suitable material that is rigid and lightweight, yet heavy enough to provide a stable support for the system 10. It is be understood that while the post 14 and the base 16 both have circular cross-sectional shapes, other crosssectional configurations, such as square, hexagonal, etc., can be used without departing from the spirit and the scope of the invention.

The sculpturing ring 18 has a cylindrical wall 40 defining a longitudinal axial bore 42 having a diameter that is dimensioned to permit the sculpturing ring 18 to be placed over the upright support post 14 with a loose fit. The sculpturing ring 18 has a first open end 44 that communicates through a longitudinal axial bore 42 with a second open end 46. A plurality of longitudinal slots 48 are formed in the wall 40 of the sculpturing ring 18, with each slot 48 opening to the first end 44 and extending approximately two-thirds the distance to the second end 46.

Figure 4:
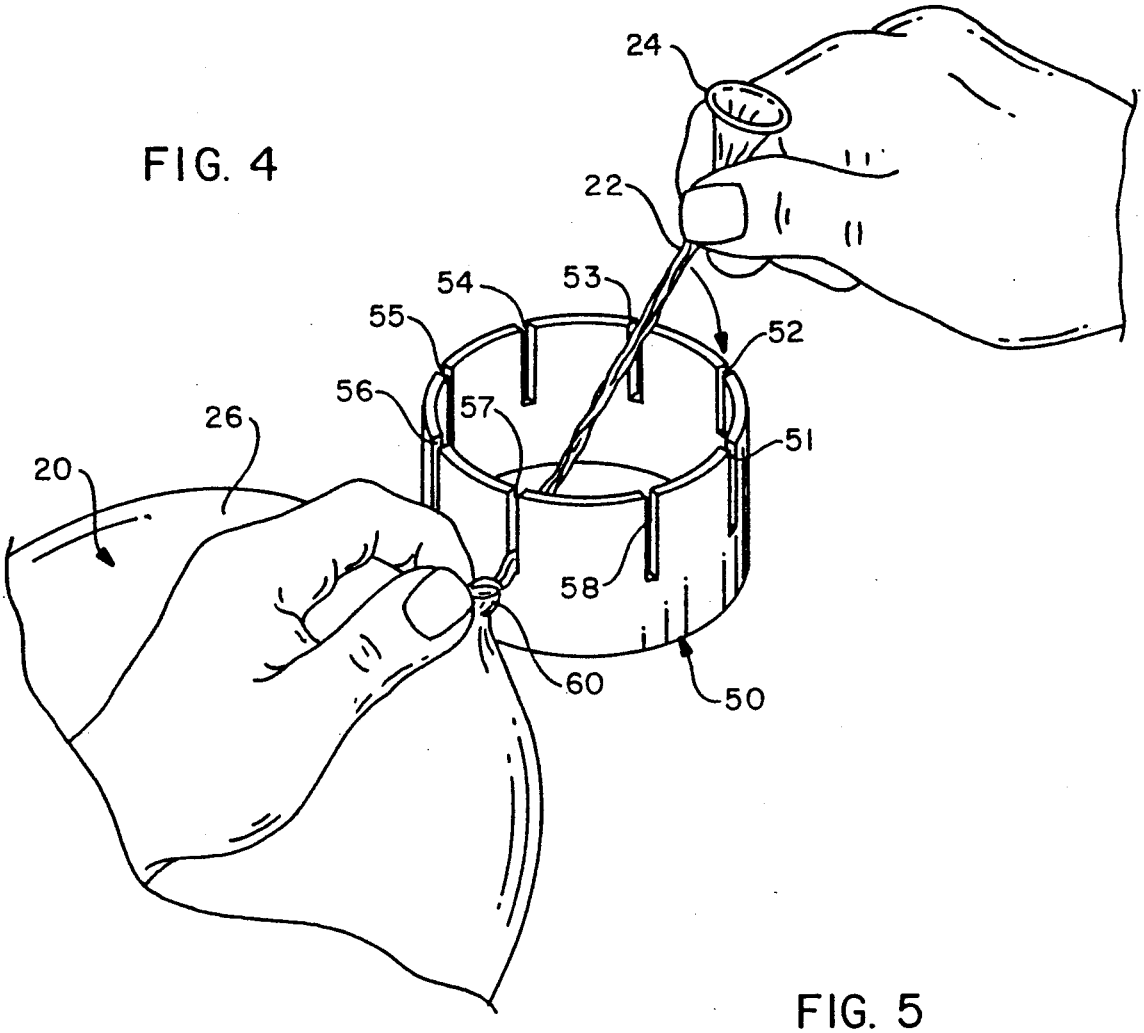
FIG. 4 is an isometric view of a mounting ring illustrating the mounting of the neck portion of a balloon thereto.

More particularly, there are eight slots 48 arranged in four pairs of adjacent slots 48, with each pair of slots being diametrically opposed from another pair of slots, i.e., the pairs of slots 48 are spaced 90 degrees apart around the circumference of the sculpturing ring 18. By way of example, FIG. 4 illustrates a sculpturing ring 50 having eight slots numbered 51–58. Slots 58 and 51 form one pair of slots diametrically opposed from a second pair of slots 54 and 55. Similarly, slots 52 and 53 form a pair of slots that are diametrically opposed from another pair of slots 56 and 57. It is preferable that the linear distance between each pair of slots be no greater than the outside diameter of the support post 14. Thus, the linear distance measured between slots 58 and 51, 52 and 53, 54 and 55, and 56 and 57 must be no greater than the outside diameter of the upright support post 14, and, ideally, should be slightly smaller than the outside diameter of the upright support post 14. Preferably, each of the slots 51–58 are sized to receive the neck portion 22 of a balloon 20 in frictional engagement to hold the neck portion 22 in position on the ring 50. While the neck portion 22 of the balloon may be secured in some other way to prevent the escape of air or other gas from inside the imperforate sidewall 26, such as typing a knot 60, the slots 51–58 can also be sized to crimp the latex material of neck portion 22 of the balloon 20 closed to prevent the escape of gas therefrom.

Figure 5:
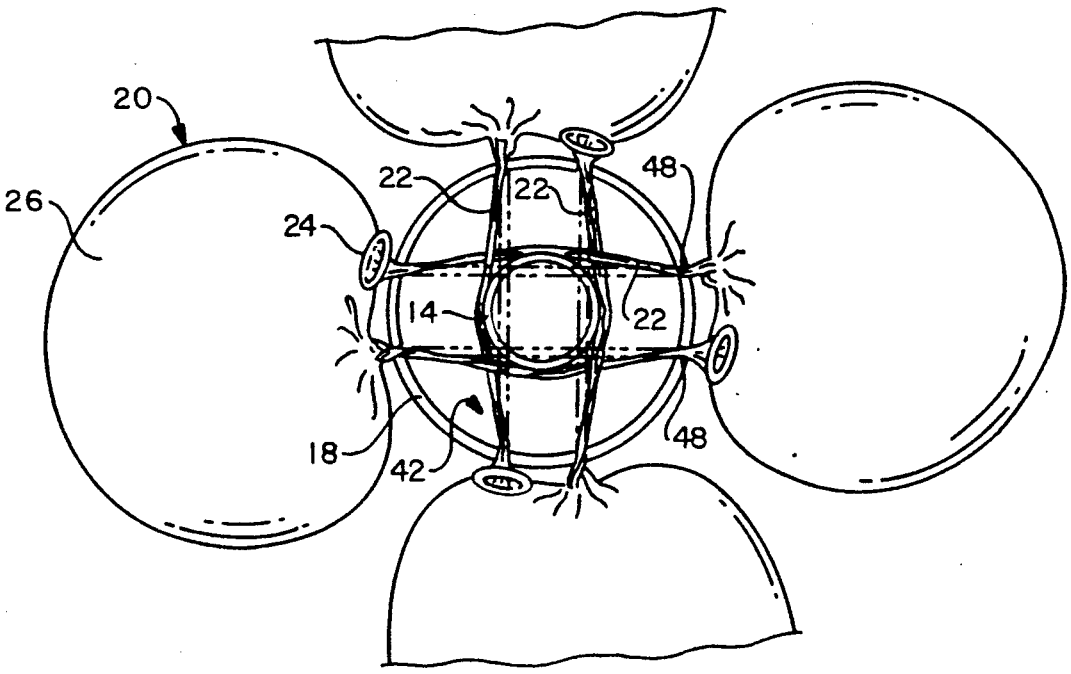
FIG. 5 is an enlarged top plan view of an assembled balloon sculpturing system formed in accordance with the present invention having four balloons mounted thereon.

Turning now to FIG. 5, four balloons 20 are shown mounted on the slots 48 on the sculpturing ring 18. The sculpturing ring 18 in turn is slid over the upright support post 14 and is held in position by the neck portions 22 of the balloons 20. More particularly, because the spacing of the slots in each pair of slots 48 is a linear distance no greater than the outside diameter of the upright support post 14, the neck portions 22 of the balloons 20 will be stretched to frictionally engage the outside of the post 14 as shown to hold the sculpturing ring 18 at a desired location on the post 14. To accomplish this, the neck portions 22 of the balloons 20 should not be stretched across the bore 42 of the ring 18 so that they cross the longitudinal axis of the bore 42. In the embodiment illustrated in FIG. 5, the phantom lines indicate the position of the neck portions 22 when first mounted on the ring 18 and prior to assembly on the upright support post 14. As can be seen, the neck portions 22 are spaced apart a linear distance that is smaller than the diameter of the post 14 so that upon mounting of the ring 18 over the post 14, the neck portions 22 will have to bend out around the outside of the post 14. This creates tension between the neck portions 22 and the post 14. This tension holds the balloons 20 and the sculpturing ring 18 to the post 14.

Although four balloons are illustrated in FIG. 5, multiple balloons can be mounted in each of the slots 48, as is illustrated in FIG. 3 where two balloons are mounted in each slot 48 on the sculpturing ring 18. Although the upright support post 14 shown in FIGS. 3 and 5 has an outside diameter significantly smaller than the diameter of the sculpturing ring 18, it is possible to use an upright support post having a larger diameter than the post as shown, but still smaller than the inside diameter of ring 18. In such instances, it may be desirable to reposition the neck portions 22 of the balloons 20 to facilitate mounting of the sculpturing ring 18 and balloons 20 to the post. For instance, referring to FIG. 4, the balloon 20 illustrated therein has its neck portion 22 installed across slots 57 and 52. In order to accommodate a larger diameter post, the neck portion 22 could be installed across slots 57 and 51 or even 57 and 58. Furthermore, in situations where the diameter of the support post 14 is significantly smaller than the sculpturing ring 18, the neck portions 22 could be mounted on the ring 18 to cross over each other. In that case, at least four balloons 20 would have to be used in order to provide tension on both sides of the post 14.

FIG. 6 illustrates an alternative embodiment of the present invention wherein the balloon sculpturing system 62 has the support post 64 mounted on a base 66 that is attached to a vertical structure 68, such as a wall. The support post 64 extends horizontally from the vertical structure 68 so that the cluster of balloons will be vertically oriented. Thus, the invention is not limited to a freestanding display on a horizontal surface.

It is also possible for the sculpturing ring to be used in combination with other supporting structures. For instance, in FIG. 7 the sculpturing ring 70, having a decorative arrangement of a multiplicity of balloons 74 mounted thereon, is mounted over a flower vase 72. The versatility of the present invention is further illustrated in FIG. 8, wherein a plurality of sculpturing rings 76 are mounted to a single upright support post 78. Thus, many different arrangements are possible using the sculpturing system of the present invention.

FIG. 9 illustrates an alternative embodiment of the present invention wherein a sculpturing disk 80 is used in place of a sculpturing ring 18. The sculpturing disk 80 is formed from a flat, circular plate 82 having a central opening 84 and a plurality of slots 86 formed in the body of the plate 82. Each slot 86 opens to an outside edge 88 and extends partially radially inward towards the opening 84. Adjacent slots 86 are positioned together in pairs 90 that are spaced equidistantly around the circumference of the disk 80. In other words, each pair 90 of adjacent slots 86 are diametrically opposed from a matching 90 of slots 86. In the embodiment shown in FIG. 9, four pair 90 of slots are positioned in diametrically opposed groups on the disk 80. Although four pair 90 of slots are illustrated, it is to be understood that only two pair 90 of slots 86 diametrically positioned on the sculpturing disk 80 need be used, and additional pairs may also be used.

These slots 86 illustrated in FIG. 9 open at the outside edge 88 of the disk 80 and have their sides converging towards one another as they project radially inward to form a triangularly-shaped slot. It is to be understood, however, that slots having parallel sides may also be used if desired. A balloon 92 is illustrated having a neck portion 94 already inserted in one slot 86 and an aperture portion 96 ready to be inserted in another slot 86. FIG. 10 illustrates a balloon sculpturing system 98 formed from a plurality of support posts 100 that are interconnected to form a tree-like arrangement and a plurality of balloons 102 mounted on one support post 100 with the sculpturing disk 80. A plurality of sculpturing disks 80 having a multiplicity of balloons 102 mounted thereon can be used on all of the support posts 100 to form a colorful arrangement of balloons 102 that, if desired, can be used to provide a full arrangement of balloons 102 that hide the support structure 100 from view.

While a preferred embodiment of the present invention has been illustrated and described, it is to be appreciated that other changes can be made therein without departing from the spirit and scope of the present invention. For instance, support posts may be attached to each other to form a tree-like arrangement and one or more sculpturing rings can be mounted to each of the posts to create a tree-like arrangement of balloons. Furthermore, the posts may be of varying lengths and diameters. Thus, the invention is to be limited only by the scope of the claims that follow.

The embodiments of the invention in which an exclusive property or privilege is claimed are defined as follows:

1. A balloon sculpturing system for displaying a decorative arrangement of one or more balloons of the type having a constricted neck portion terminating at one end in an inflation aperture and at the other end in an imperforate inflatable sidewall, the balloon sculpturing system comprising:

post means comprising one or more posts; and means for holding one or more balloons and for mounting the one or more balloons to said post means such that the neck portion of the one or more balloons frictionally engages said post means to retain said holding and mounting means at a desired location on said post means.

2. The balloon sculpturing system of claim 1, wherein said holding and mounting means comprises a wall member having a central opening sized to be slidably receivable over said post means and at least two diametrically opposed pair of adjacent slots, each slot being sized to hold the neck portion of each balloon in the sealed configuration, said slots in each pair of adjacent slots being spaced apart a linear distance no greater than the thickness of said post means.

3. The balloon sculpturing system of claim 2, wherein said wall member comprises a cylindrical wall having a first end, a second end, and a central longitudinal bore communicating with the first and second ends, and further wherein each of said slots opens to either of said first and second ends and partially extends longitudinally toward the other of said first and second ends.

4. The balloon sculpturing system of claim 3, further including means for supporting said post means on a support surface.

5. A balloon sculpturing system for forming and displaying a decorative arrangement of a plurality of balloons of the type having a constricted neck portion terminating at one end in an inflation aperture and at the other end in an imperforate inflatable sidewall, the balloon sculpturing system comprising:

at least one stand for supporting the system on a support surface;

one or more elongate posts coupled to said at least one stand; and means for holding the plurality of balloons such that the neck portion of each balloon is held in a sealed configuration wherein gas is prevented from escaping from each balloon and for mounting the plurality of balloons to one of said one or more elongate posts such that the neck portion of the plurality of balloons frictionally engages said post to retain said holding and mounting means at a desired location on said post.

6. The balloon sculpturing system of claim 5, wherein said holding and mounting means comprises one or more holders, each holder having a central opening sized to be slidably received over one of said elongate posts and at least two diametrically opposed pair of adjacent slots, each slot being sized to hold the neck portion of each balloon in the sealed configuration, said slots in each pair of adjacent slots being spaced apart a linear distance no greater than the thickness of said elongate post and, further wherein a first pair of slots is diametrically opposed from a second pair of slots.

7. The balloon sculpturing system of claim 6, wherein said holder comprises a cylindrical ring having a first end communicating with a second end through a central longitudinal bore, and further wherein each of said slots opens to either of said first and said second ends and partially extends longitudinally toward the other of said first and said second ends.

8. The balloon sculpturing system of claim 7, wherein the central longitudinal bore of each ring has a longitudinal axis at its center point, and further wherein each pair of slots is positioned on the circumference of said ring such that the neck portion of a balloon placed in the slots and stretched across the central longitudinal bore will not intersect the midpoint of the central longitudinal bore.

9. A balloon sculpturing system for displaying a decorative arrangement of two or more balloons of the type having a constricted neck portion terminating at one end in an inflation aperture and at the other end in an imperforate inflatable sidewall, the balloon sculpturing system comprising:

an elongate mounting member having one end adapted to support the system on a supporting surface; and a balloon holding ring having a central longitudinal bore sized to be slidably received over said elongate mounting member and at least two diametrically opposed pair of adjacent slots, each slot being sized to hold the neck portion of each balloon in a sealed configuration wherein gas is prevented from escaping from the balloon; each pair of adjacent slots being positioned on the ring such that the neck portion of a balloon is placed in diametrically opposed slots and is stretched across the central longitudinal bore and does not intersect the longitudinal axis of the central longitudinal bore of the ring such that the neck portion of each balloon frictionally engages said elongate mounting member to retain said ring at a desired location on said post.

10. The balloon sculpturing system of claim 9, wherein each ring comprises a wall member having a cylindrical shape with a first end that communicates with a second end through the central longitudinal bore, and further wherein all of said slots open to either of said first and second ends and partially extend longitudinally toward the other of said first and second ends.

11. A balloon sculpturing system for displaying a decorative arrangement of balloons of the type having a constricted neck portion terminating at one end in an inflation aperture and at the other end in an imperforate inflatable sidewall, the balloon sculpturing system comprising, in combination:

one or more elongate mounting members;

one or more rings, each ring having a central opening sized to be slidably received over the elongate mounting member and at least two diametrically opposed pair of adjacent slots, each slot being sized to hold the neck portion of a balloon in a sealed configuration wherein gas is prevented from escaping from the balloon, each pair of adjacent slots being positioned at the outer circumference of the ring such that the neck portion of a balloon is stretched across the central opening to frictionally engage the elongate mounting member and retain the ring at a desired location on said elongate mounting member; and two or more balloons mounted on each of said one or more rings, each balloon having a neck portion that is engaged with a pair of slots on said ring to frictionally engage said elongate mounting member.

12. The balloon sculpturing system of claim 11, further including a base attached to said elongate mounting member to support the balloon sculpturing system on a supporting surface.

13. A balloon sculpturing ring for use in combination with an elongate supporting member for mounting and displaying a decorative arrangement of a plurality of balloons of the type having a constricted neck portion terminating at one end in an inflation aperture and at the other end in an imperforate inflatable sidewall, said sculpturing ring comprising:

a cylindrical wall having a first open end communicating with a second open end through a longitudinal axial bore; and at least three slots formed in said cylindrical wall, each of said slots being sized to hold the neck portion in frictional engagement, said at least three slots being positioned around the circumference of said cylindrical wall such that the neck portions will stretch across said longitudinal axial base without intersecting the longitudinal axis of said bore and will frictionally engage the supporting member over which said cylindrical wall is placed to hold the sculpturing ring in a desired location on the supporting member.

14. The balloon sculpturing ring of claim 13, further comprising one or more sets of two pair of slots formed in said cylindrical wall, with said pair of slots being positioned in diametric opposing relationship on said cylindrical wall, and, further, with all of said slots in a set opening to one end of said cylindrical wall with each of said slots in a pair being separated a predetermined distance such that when the neck portions of a pair of balloons are frictionally engaged with said slots in a set of two pair of slots, the neck portions will stretch across said longitudinal axial bore in spaced-parallel relationship without passing through the longitudinal axis of said longtudinal axial bore to thereby frictionally engage the supporting member over which said cylindrical wall is placed to thereby hold the sculpturing ring in a desired location on the supporting member.

15. A balloon sculpturing disk for use in combination with an elongate supporting member for mounting and displaying a decorative arrangement of a plurality of balloons of the type having a constricted neck portion terminating at one end in an inflation aperture and at the other end in an imperforate inflatable sidewall, said sculpturing disk comprising:

a base plate having a central opening formed thereon and an outside edge to finding a perimeter of the plate; and a plurality of slots formed in said base plate, each of said plurality of slots opening to said outside edge and projecting inward towards said central opening and being sized and shaped to frictionally engage the neck portion of each of the balloons, said plurality of slots being arranged in one or more sets of two pair of slots, with said first pair of slots in a set being positioned in diametric opposing relationship to said second pair of slots on said base, and, further, with said slots in a pair being separated a predetermined distance that is less than the distance between adjacent pairs of slots such that when the neck portions of a pair of balloons are frictionally engaged with said slots, the neck portions will stretch across said opening in said base plate in spaced-parallel relationship without passing through the center point of said central opening to thereby enable frictional engagement with the supporting member over which said base plate is placed to hold the sculpturing disk in a desired location on the supporting member.

16. The sculpturing disk of claim 15, wherein said base base plate has a circular platform shape and said central opening has a circular shape.

17. A method for forming and displaying a decorative arrangement of a plurality of balloons of the type having a constricted neck portion terminating at one end in an inflation aperture and at the other end in an imperforate inflatable side wall using a balloon sculpturing system having at least one support post and at least one mounting member having a central opening that is sized to be slidably received over a support post and a plurality of slots formed thereon for frictionally engaging the neck portion of a balloon, the method comprising the steps of:

inflating a balloon;

stretching the neck portion of the balloon and placing it into a pair of slots on the mounting member such that the neck portion is stretched across the central opening of the mounting member;

inflating a second balloon;

stretching the neck portion of the second balloon and placing it into a second set of slots on said mounting member such that the neck portion is stretched across the central opening of the mounting member and is positioned a maximum transverse dimension from the neck portion of the first balloon that is smaller than the diameter of the support post; and placing the mounting member and the associated balloons over a support post such that the support post protrudes through the central opening and the neck portions of the balloons frictionally engage the support post to hold the mounting member and the associated balloons in position on the support post.

18. The method of claim 17, further including the additional steps of inflating one or more balloons and stretching the neck portion of the one or more balloons and inserting them into slots on the mounting member such that the neck portions of the one or more balloons extend across the central opening of the mounting member.

19. The method of claim 18, wherein the step of inflating the balloons further includes the step of sealing the neck portion of each of the balloons to prevent the escape of gas therefrom.

* * * * *